US011504586B2

(12) United States Patent
LeBlanc et al.

(10) Patent No.: US 11,504,586 B2
(45) Date of Patent: Nov. 22, 2022

(54) GOLF CLUB HEAD WITH REINFORCED CHANNEL

(71) Applicant: Callaway Golf Company, Carlsbad, CA (US)

(72) Inventors: Dominic LeBlanc, Encinitas, CA (US); Christopher A. G. Nunez, Escondido, CA (US); Brandon D. DeMille, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 18 days.

(21) Appl. No.: 17/390,758

(22) Filed: Jul. 30, 2021

(65) Prior Publication Data

US 2022/0184467 A1 Jun. 16, 2022

Related U.S. Application Data

(60) Provisional application No. 63/126,183, filed on Dec. 16, 2020.

(51) Int. Cl.

| | |
|---|---|
| ***A63B 53/04*** | (2015.01) |
| *A63B 102/32* | (2015.01) |
| *A63B 53/06* | (2015.01) |

(52) U.S. Cl.

CPC ..... *A63B 53/0433* (2020.08); *A63B 53/045* (2020.08); *A63B 53/0466* (2013.01); *A63B 53/06* (2013.01); *A63B 2053/0491* (2013.01); *A63B 2102/32* (2015.10)

(58) Field of Classification Search

CPC ..... A63B 53/0433; A63B 53/0455
USPC ..... 473/324–350
See application file for complete search history.

(56) References Cited

U.S. PATENT DOCUMENTS

| | | | | |
|---|---|---|---|---|
| 4,934,702 | A * | 6/1990 | Serizawa | A63B 53/0487 473/286 |
| 6,440,006 | B1 * | 8/2002 | Johnson | A63B 53/0487 473/340 |
| 7,896,753 | B2 | 3/2011 | Boyd et al. | |
| 9,427,631 | B1 * | 8/2016 | Larson | A63B 60/50 |
| 10,398,952 | B1 * | 9/2019 | Yi | A63B 53/0433 |
| 10,799,775 | B2 | 10/2020 | Sargent et al. | |
| 2011/0151997 | A1 * | 6/2011 | Shear | A63B 60/00 473/332 |
| 2011/0218053 | A1 * | 9/2011 | Tang | A63B 60/00 473/349 |
| 2012/0135821 | A1 * | 5/2012 | Boyd | A63B 60/54 473/342 |

(Continued)

FOREIGN PATENT DOCUMENTS

CN 101077449 A * 11/2007 ..... A63B 53/04

*Primary Examiner* — Alvin A Hunter

(74) *Attorney, Agent, or Firm* — Rebecca Hanovice; Michael A. Catania; Sonia Lari

(57) ABSTRACT

A golf club head with a channel sized to receive one or more adjustable weights and an external support structure that bridges, and thereby supports, the channel without unduly interfering with weight adjustment is disclosed herein. The support structure, which includes one or more stiffening members on the exterior of the golf club head, improves the sound quality of the golf club head, and is particularly useful to attenuate the lower frequency mode shapes associated with slider channel geometry in golf club heads.

20 Claims, 13 Drawing Sheets

(56) References Cited

U.S. PATENT DOCUMENTS

2012/0142452 A1* 6/2012 Burnett ..... A63B 53/0475 473/345
2012/0196701 A1* 8/2012 Stites ..... A63B 53/06 473/324
2012/0196703 A1* 8/2012 Sander ..... A63B 60/52 473/349
2012/0202615 A1* 8/2012 Beach ..... A63B 53/06 473/345
2013/0210542 A1* 8/2013 Harbert ..... A63B 53/06 473/338
2013/0316848 A1* 11/2013 Burnett ..... A63B 60/52 473/345
2013/0331201 A1* 12/2013 Wahl ..... A63B 60/00 473/329
2014/0080626 A1* 3/2014 Bezilla ..... A63B 60/52 473/332
2014/0080627 A1* 3/2014 Bennett ..... A63B 60/52 473/332
2014/0080634 A1* 3/2014 Golden ..... A63B 53/0466 473/345
2014/0335973 A1* 11/2014 Takechi ..... A63B 53/047 473/349
2015/0133232 A1* 5/2015 Taylor ..... A63B 53/0475 473/329
2016/0096081 A1* 4/2016 Boggs ..... A63B 60/00 473/324
2016/0114227 A1* 4/2016 Ghods ..... A63B 53/0466 473/327
2016/0129319 A1* 5/2016 Bennett ..... A63B 53/0466 473/345
2016/0375326 A1* 12/2016 Nunez ..... A63B 53/0466 473/335
2017/0165535 A1* 6/2017 Frame ..... A63B 53/0466
2017/0165536 A1* 6/2017 Yi ..... A63B 53/0466
2020/0330834 A1* 10/2020 Northcutt ..... A63B 60/04
2020/0330835 A1* 10/2020 Bennett ..... A63B 53/06
2022/0184467 A1* 6/2022 LeBlanc ..... A63B 53/045

* cited by examiner

GOLF CLUB HEAD WITH REINFORCED CHANNEL

CROSS REFERENCES TO RELATED APPLICATIONS

The present application claims priority to U.S. Provisional Patent Application No. 63/126,183, filed on Dec. 16, 2020, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with a channel and bridging structures extending over at least a portion of the channel to improve the overall sound of the golf club head upon impact with a golf ball.

Description of the Related Art

The center of gravity (CG) of a golf head is crucial to its performance because it affects the spin and launch profile of a golf ball as it leaves the golf head. Because of this, adjustability in the perimeter weighting of a golf head can provide great benefits to the golfer. Interchangeable weights can be used to achieve these performance benefits, as can the inclusion of one or more moveable weights in or on a track to provide additional CG adjustment options. However, the geometry of a channel or track, and in particular the thin-walled, pocket-type structure, can lead to low frequency vibrations shortly after the impact, which are linked to an unappealing sound after the ball leaves the club head.

Prior art golf club heads, such as the one shown in FIGS. 1-5, have addressed this problem with sound through the inclusion of internal ribs 50, which stiffen a portion of the golf club head on or around the channel 60. Unfortunately, this internal rib 50 structure moves mass away from the periphery of the golf club head, which can negatively affect the mass properties of the club. This configuration also hides important technology from the view of the golfer.

Therefore, there is a need for a golf club head with improved structures that allow for weight adjustability without negatively affecting sound upon impact with a golf ball.

BRIEF SUMMARY OF THE INVENTION

One aspect of the present invention is a golf club head with a channel supported by external structures such as ribs, struts, or pads that attenuate sound of the golf club head upon impact with a golf ball. The golf club head is preferably a driver or other wood-type head, and the channel is preferably located in the sole.

Another aspect of the present invention is a golf club head comprising a body comprising a sole with a channel, and a support structure comprising at least one stiffening member, the support structure bridging at least a portion of the channel, wherein the at least one stiffening member comprises an Member Area representing the area of the at least one stiffening member that bridges the channel, wherein the channel comprises a Total Channel Area, wherein the support structure comprises a Total Member Area, which is equivalent to $$\sum_{i=1}^{n} \text{Area } Member_i,$$

wherein n=the number of stiffening members, wherein $$Member_{ratio} = \frac{\text{Total Member Area}}{\text{Total Channel Area}},$$

and wherein $\text{Member}_{Ratio}$ is no less than 0.001 and no greater than 1.

In some embodiments, $\text{Member}_{Ratio}$ may be no less than 0.02 and no greater than 0.90. In a further embodiment, $\text{Member}_{Ratio}$ may be no less than 0.10 and no greater than 0.50. In another embodiment, the at least one stiffening member may comprise a first stiffening member and a second stiffening member. In a further embodiment, the first stiffening member may be disposed proximate a first end of the channel, and the second stiffening member may be disposed proximate a second end of the channel. In another embodiment, the first stiffening member may be spaced from a first end of the channel by a first distance, and the first stiffening member may be spaced from the second stiffening member by a second distance, and the first distance may be approximately equal to the second distance.

In other embodiments, the support structure may be integrally formed with the body. In another embodiment, the support structure may be formed separately from the body and then be affixed to the body. In a further embodiment, the body may comprise first and second recesses on opposite sides of the channel, and the support structure may sit at least partially within the first and second recesses. In a further embodiment, first and second ends of the support structure may be welded, brazed, or affixed via adhesive within the first and second recesses, respectively. In an alternative embodiment, the support structure may be affixed to the body with one or more adhesives, brazes, or welds. In another embodiment, the at least one stiffening member may be an approximately rectangular plate that is removably affixed to the body. In yet another embodiment, the at least one stiffening member may have an hourglass shape.

Yet another aspect of the present invention is a golf club head comprising a body comprising a sole with a channel, and a support structure comprising a plurality of planar stiffening members, the support structure bridging at least a portion of the channel, wherein each stiffening member of the plurality of planar stiffening members comprises an Area Member representing the area of each planar stiffening member that bridges the channel, wherein the channel comprises a Total Channel Area, wherein the support structure comprises a Total Member Area, which is equivalent to $$\sum_{i=1}^{n} \text{Area } Member_i,$$

wherein n=the number of planar stiffening members, wherein $$Member_{ratio} = \frac{\text{Total Member Area}}{\text{Total Channel Area}},$$

and wherein $Member_{Ratio}$ is no less than 0.001 and no greater than 1.

In some embodiments, at least one stiffening member of the plurality of stiffening members may comprise a rib extending along a longitudinal axis of the at least one stiffening member. In other embodiments, each stiffening member of the plurality of stiffening members may comprise a thickness of 0.015 to 0.150 inch. In another embodiment, at least one stiffening member of the plurality of stiffening members may bridge a midpoint of the channel. In some embodiments, at least one stiffening member of the plurality of stiffening members may be composed of a material that differs from a material of the body. In any of the embodiments, at least one stiffening member of the plurality of stiffening members may have an hourglass shape. In a further embodiment, each stiffening member of the plurality of stiffening members may have an hourglass shape.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head 10 with a channel 60 sized to receive one or more adjustable weights through clamping attachment to one or more structures 61, 63 disposed within the channel 60, and an external support structure that bridges, and thereby supports, the channel 60 without unduly interfering with weight adjustment. The channel 60 may have one or more of the feature of the tracks, slots, and channels shown in U.S. Pat. Nos. 8,894,506, 8,696,491, 9,724,577, and 9,731,178, the disclosure of each of which is hereby incorporated in its entirety herein. Placement of a support structure, which includes one or more stiffening members 70, on the exterior of the golf club head is a more mass efficient solution than prior art configurations intended to improve sound quality, particularly attenuation of lower frequency mode shapes associated with slider track geometry. The support structure of the present invention also reduces the amount of mass required to have this sound-improving effect when compared with prior art golf club heads.

Figure 6:
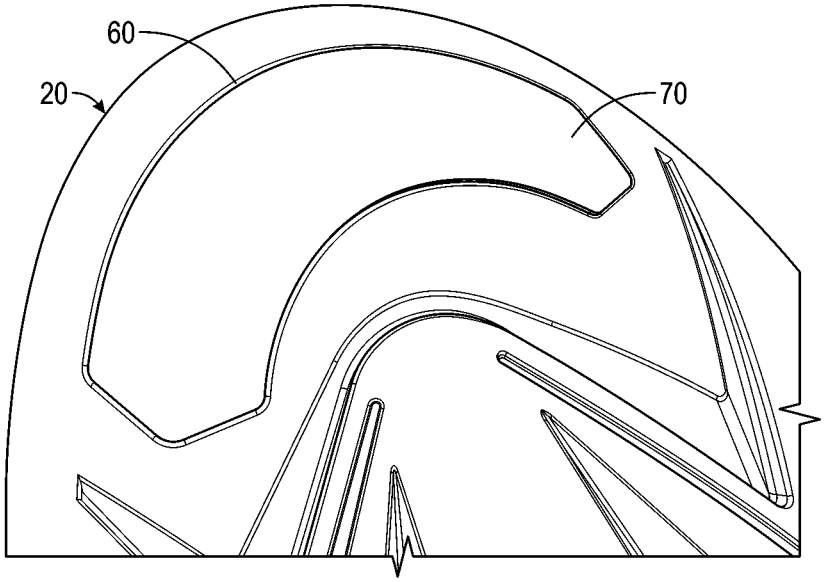
FIGS. 6 and 7 are sole perspective views of a golf club head with a channel, with shading illustrating different design spaces for external structures.
Figure 7:
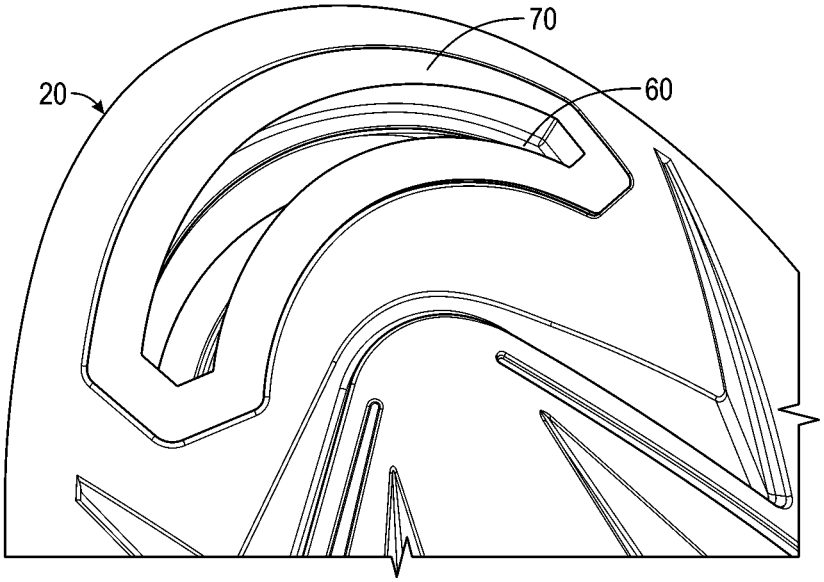

Two different support strategies for reinforcement of the channel 60 are shown in FIGS. 6-7, with FIG. 6 having a support structure comprising a single stiffening member 70 covering or bridging the entire area of the channel 60, and FIG. 7 having a support structure comprising a single stiffening member 70 covering or bridging only the edges of the channel 60. The embodiments of the present invention use the strategy disclosed in FIG. 7 so that the interior of the channel 60 is at least partially accessible to the golfer so that they can move weights within it.

Figure 8:
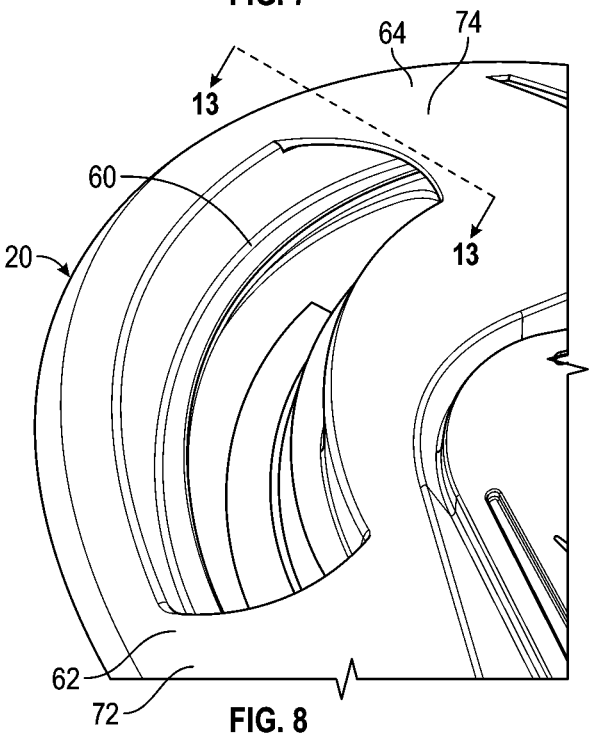
FIGS. 8-9 are sole perspective views of a first embodiment of the present invention.
Figure 9:
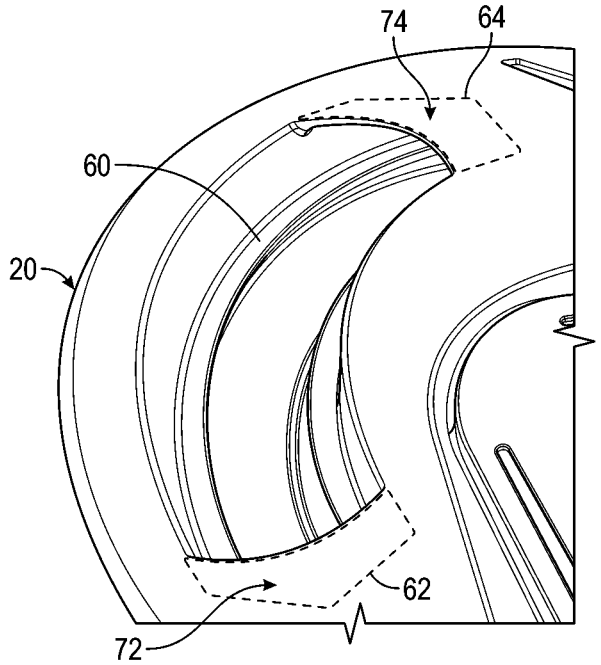
Figure 10:
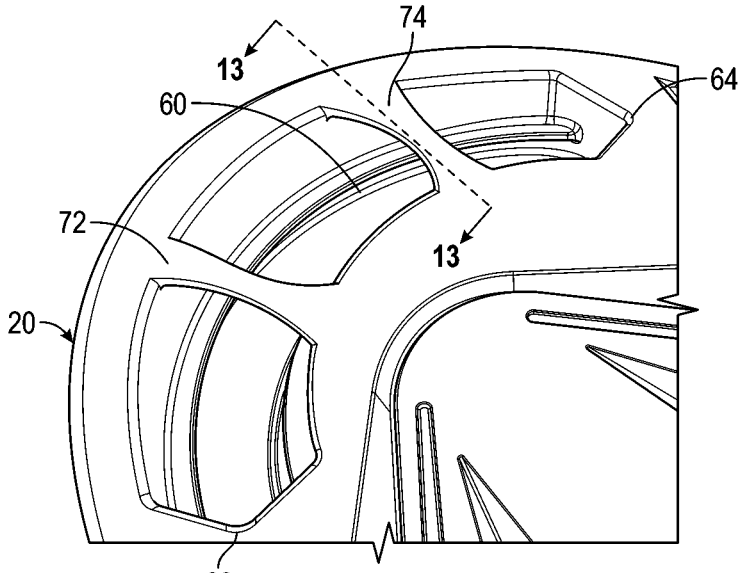
FIGS. 10-11 are sole perspective views of a second embodiment of the present invention.
Figure 11:
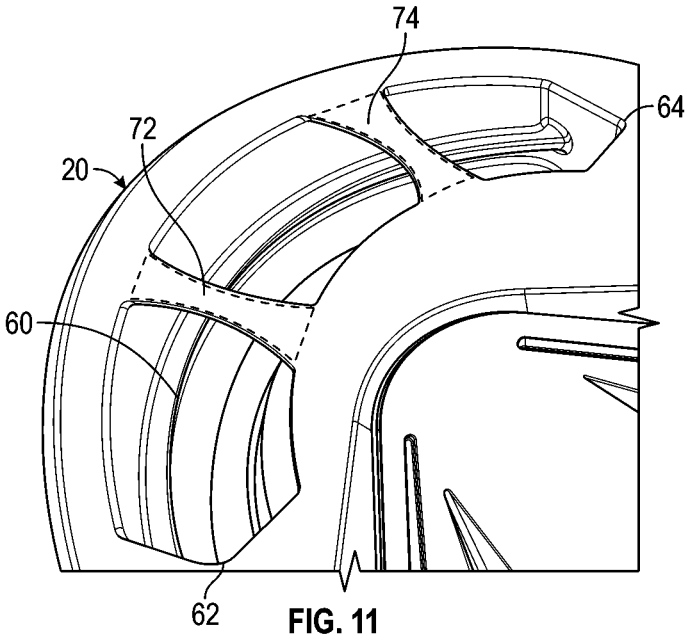
Figure 12:
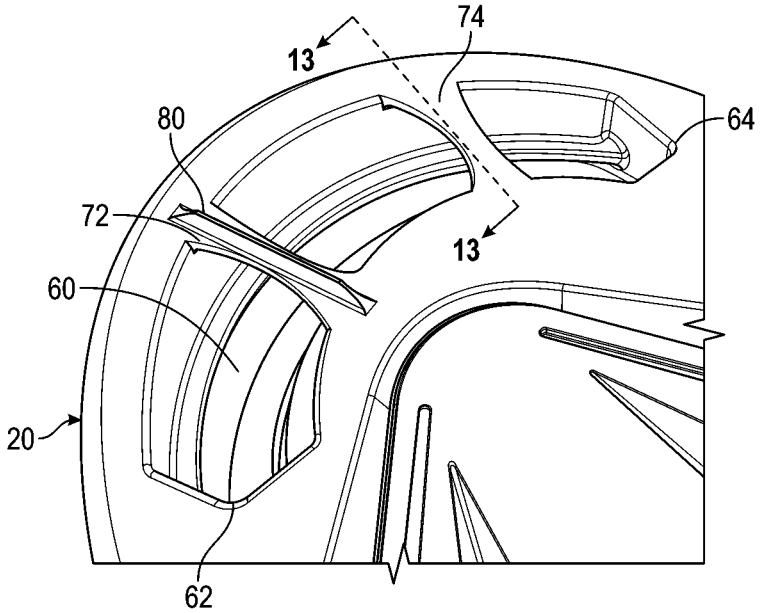
FIG. 12 is a sole perspective view of a third embodiment of the present invention.

A first embodiment of the present invention is shown in FIGS. 8 and 9. In this embodiment, a pair of stiffening members 72, 74 bridge the ends 62, 64 of the channel 60. The area of each stiffening member 72, 74 is shown in the dotted lines in FIG. 9. A second embodiment is shown in FIGS. 10 and 11. In this embodiment, a pair of stiffening members 72, 74 extend over the channel 60 and spaced apart from one another and the ends 62, 64 of the channel 60. The stiffening members 72, 74 are preferably spaced evenly apart from one another and the ends 62, 64 of the channel, though in alternative embodiments the spacing may be different. The first stiffening member 72 is spaced from one end 62 of the channel a distance of approximately one third the length of the channel, while the second stiffening member 74 is spaced from the other end 64 of the channel at a distance of approximately one third the length of the channel. The area of each stiffening member 72, 74 is shown in the dotted lines in FIG. 11. In a third embodiment, one or both of the stiffening members 72, 74 includes a rib 80 that extends along the longitudinal axis of the stiffening member 72, 74, as shown in FIG. 12, to provide further support to the structure.

Figure 13:
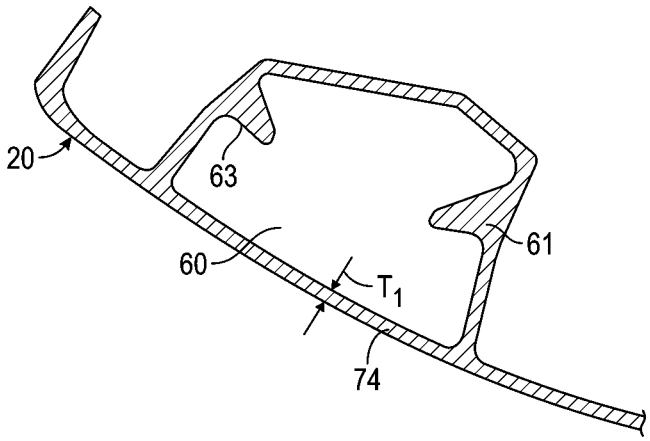
FIG. 13 is a cross-sectional view of the embodiments shown in FIGS. 8-12 taken along lines 13-13.
Figure 14:
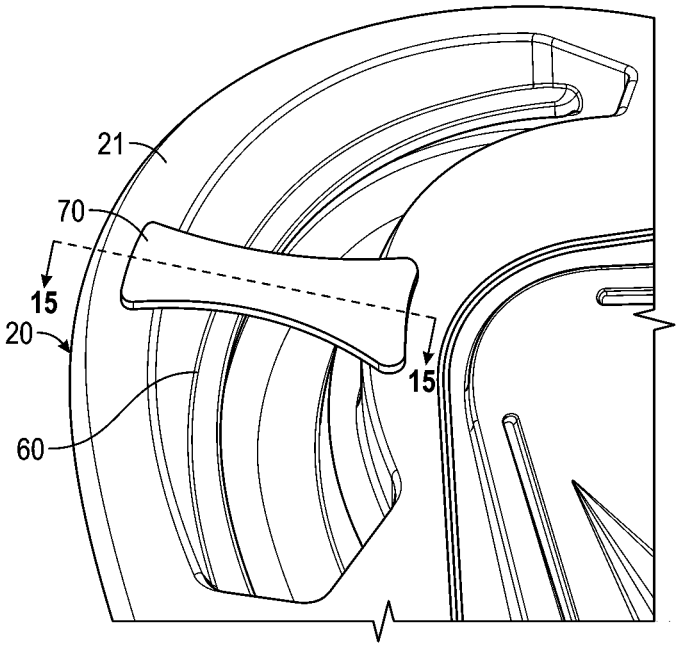
FIG. 14 is a sole perspective view of a fourth embodiment of the present invention.
Figure 15:
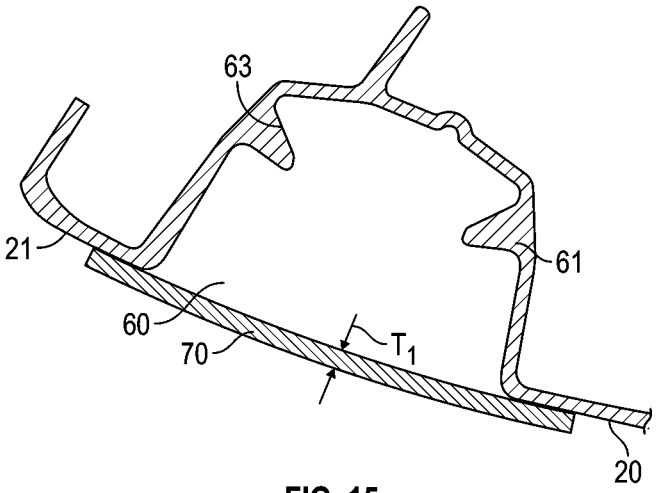
FIG. 15 is a cross-sectional view of the embodiment shown in FIG. 14 taken along lines 15-15.
Figure 23:
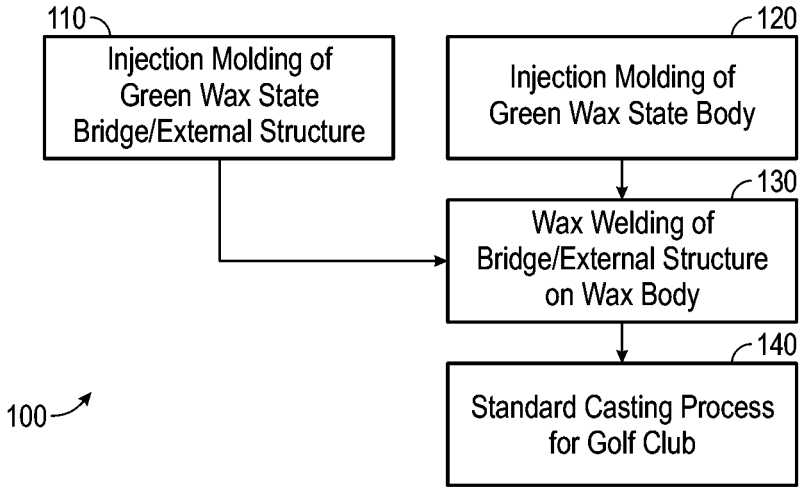
FIGS. 23-25 are process flow charts of methods of manufacturing the various embodiments of the golf club head shown herein.
Figure 24:
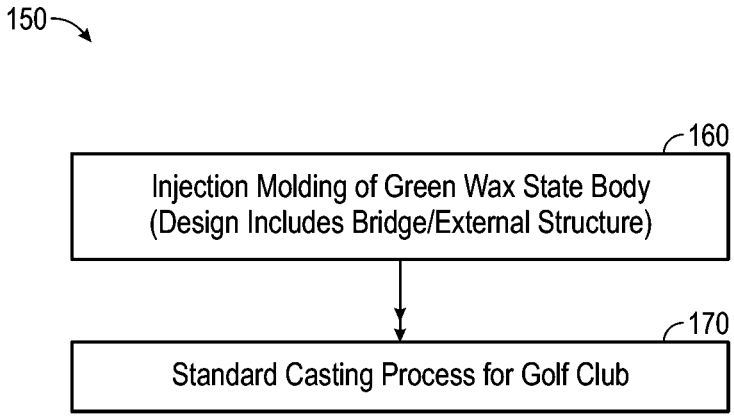

As shown in FIG. 13, the stiffening members 72, 74 of FIGS. 8-12 are integrally formed with the body 20 of the inventive golf club heads 10, and are composed of the same material as the body 20. Each stiffening member 72, 74 has a thickness $T_1$ of 0.015 to 0.150 inch. They are preferably integrally cast with the body 20 as described in the methods illustrated in FIGS. 23-24. In the first, wax welding method 100, the first and second steps 110, 120 of injection molding a wax of the one or more stiffening members 72, 74, and injection molding a wax of the body 20 of the golf club head are performed simultaneously. In the third step 130, the wax of the one or more stiffening members is welded to the wax of the body, and in the fourth step 140, the combination wax is run through the standard golf club casting process. In the third step 130, higher temperature and pressure is locally applied to the joints between the wax of the stiffening members and the wax of the body to create a unified wax body.

In the second, standard casting method 150, the first step 160 is the injection molding of the wax of the body 20 comprising the one or more stiffening members, and the second step 170 is running the wax mold through the standard golf club casting process. This method 150 requires a more complex injection molding tool to create the undercut features of the channel 60 and stiffening members 70.

A different configuration, in which the stiffening members 70 of the present invention are separate components from and are affixed to a golf club body, is shown in FIGS. 14-21. In a fourth embodiment of the present invention, shown in FIGS. 14-15, a single stiffening member 70 is affixed to external surfaces 21 of the body 20 so that the stiffening member 70 extends over the channel 60 and the stiffening member 70 is stacked on, and protrudes from, the body 20.

Figure 16:
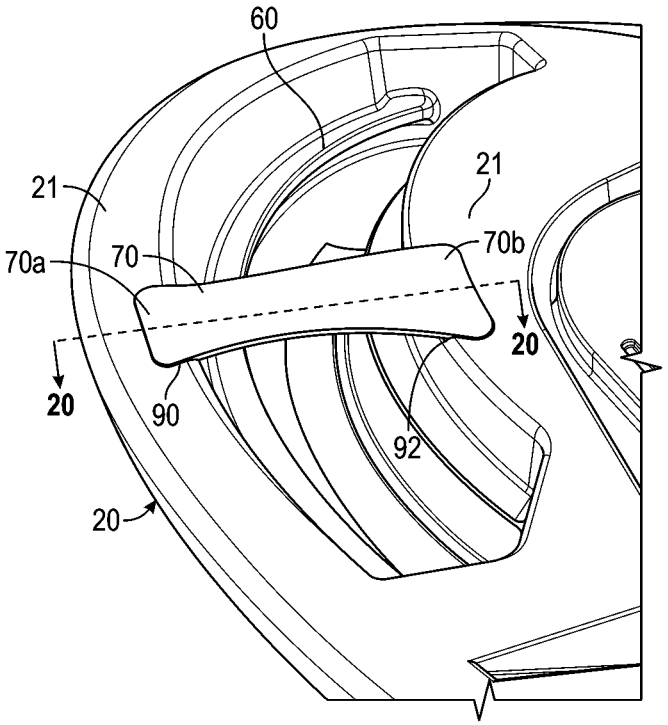
FIGS. 16-17 are sole perspective views of a fifth embodiment of the present invention.
Figure 17:
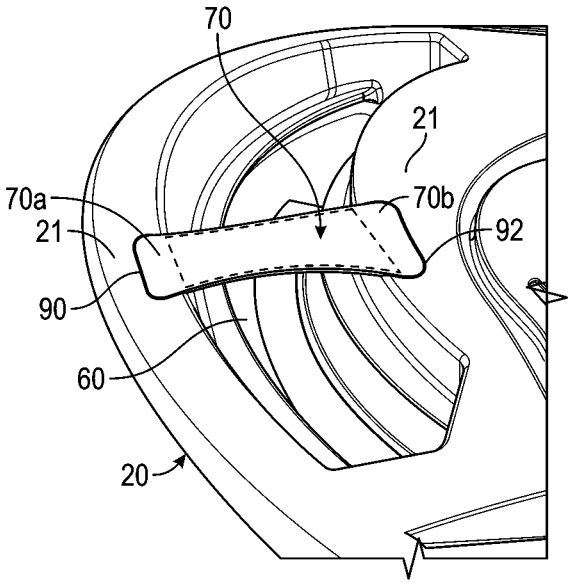
Figure 18:
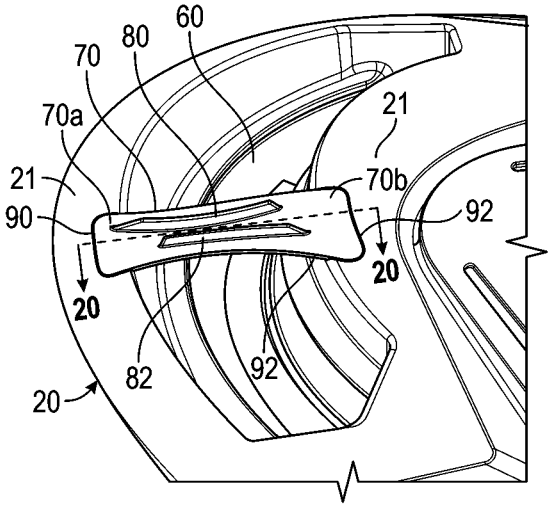
FIG. 18 is a sole perspective view of a sixth embodiment of the present invention.
Figure 19:
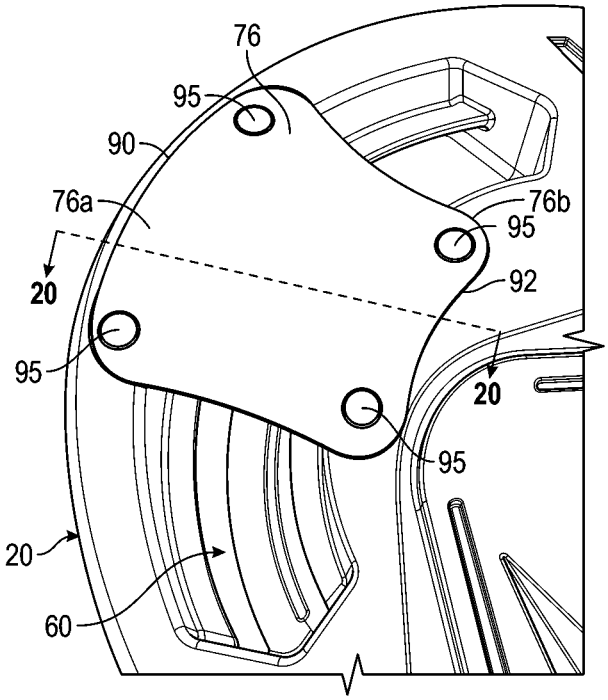
FIG. 19 is a sole perspective view of a seventh embodiment of the present invention.

In a fifth embodiment, shown in FIGS. 16-17, a single stiffening member 70 is disposed over the channel 60, preferably at a midpoint of the channel 60, with ends 70*a*, 70*b* that sit within recesses 90, 92 extending into the exterior surface 21 of the body 20 on either side of the channel 60. The area of the stiffening member 70 that covers the channel 60 is shown in the dotted lines in FIG. 17. In a sixth embodiment, the stiffening member 70 shown in FIGS. 16-17 includes reinforcing ribs 80, 82 extending longitudinally across the stiffening member 72. In a seventh embodiment, shown in FIG. 19, the stiffening member is an approximately rectangular plate 76, which is affixed to the body 20 mechanically with bolts or fasteners 95 and can be removed or replaced by the golfer to allow for easier access to the channel 60 and any weights within it. This embodiment includes the recesses 90, 92 on either side of the channel 60 within which the ends 76*a*, 76*b* of the plate 76 sit.

Figure 20:
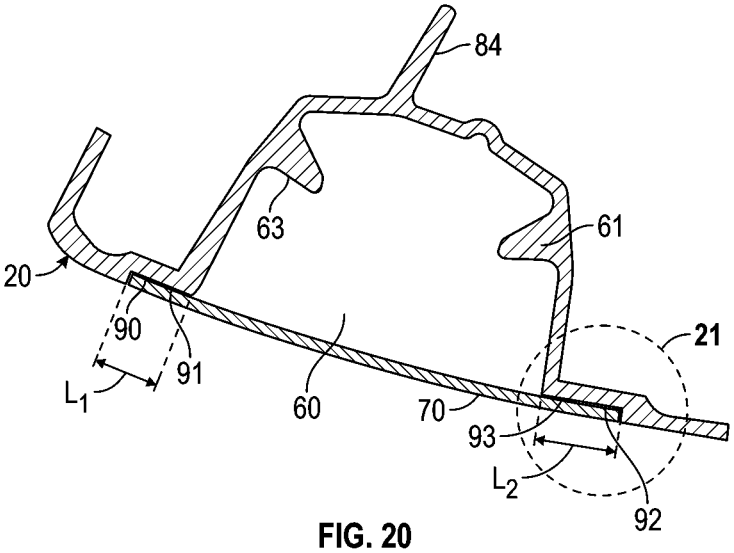
FIG. 20 is a cross-sectional view of the embodiments shown in FIGS. 16-19 taken along lines 20-20.
Figure 21:
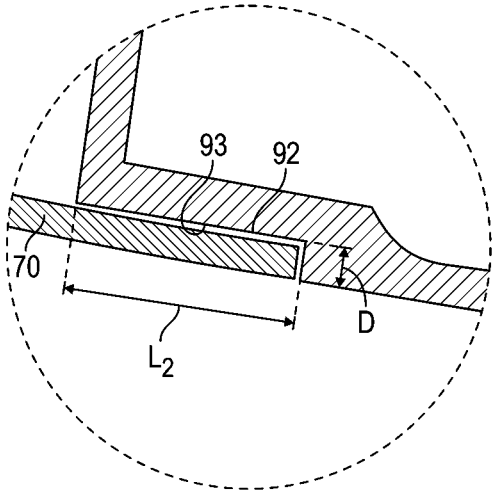
FIG. 21 is an enlarged view of the circled portion of FIG. 20.

In these embodiments, the cross-sectional structure of which is illustrated in FIG. 20, each recess 90, 92 has a bonding ledge 91, 93 with a length $L_1$, $L_2$ ranging from 0.050 inch to 0.500 inch. The bonding ledges 91, 93 are recessed into the body by a depth D of 0.010 inch to 0.100 inch. As with the first three embodiments, in these embodiments the thickness $T_1$ of the stiffening member 70 can be anywhere from 0.015 inch to 0.150 inch, but if the stiffening member 70 is to be flush with the exterior surface 21 of the body 20, then $T_1$ should be approximately equal to D.

Figure 25:
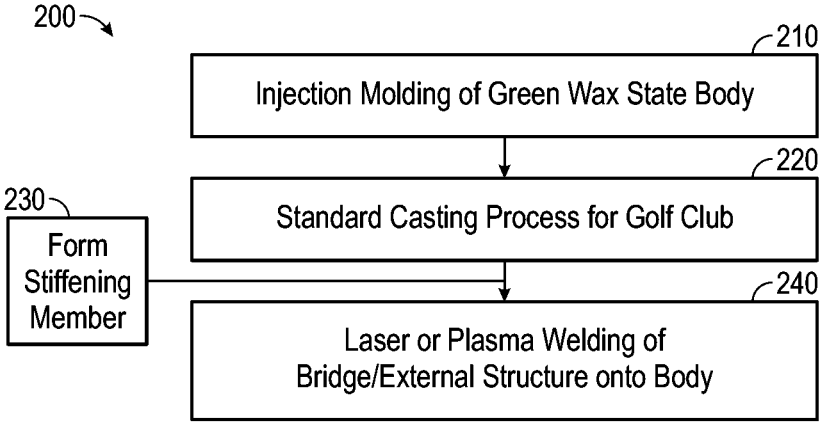

In fourth through seventh embodiments, the stiffening members 70 can be composed of any material, not just the material from which the body 20 is composed. For example, while the body 20 is preferably composed of a titanium alloy with a density ranging from 4-5 g/cc, in these embodiments the density of the material from which the stiffening members 70 are made can be 0.5-20 g/cc. The method 20 illustrated in FIG. 25 can be used to assemble the stiffening members 70 in these embodiments. In a first step 210, a wax of the body 20 is created via injection molding and then, in a second step 220, the wax is used in a standard casting process to create a golf club head. At some point in this order (concurrently with steps one 210 or two 220 or afterwards), the separate stiffening member 70 is manufactured in a third step 230. Finally, in a fourth step 240, the stiffening member is affixed to the body 20 via a laser or plasma welding process. Alternatively, the stiffening members 70 may be affixed to the body 20 with adhesive or brazing.

Figure 5:
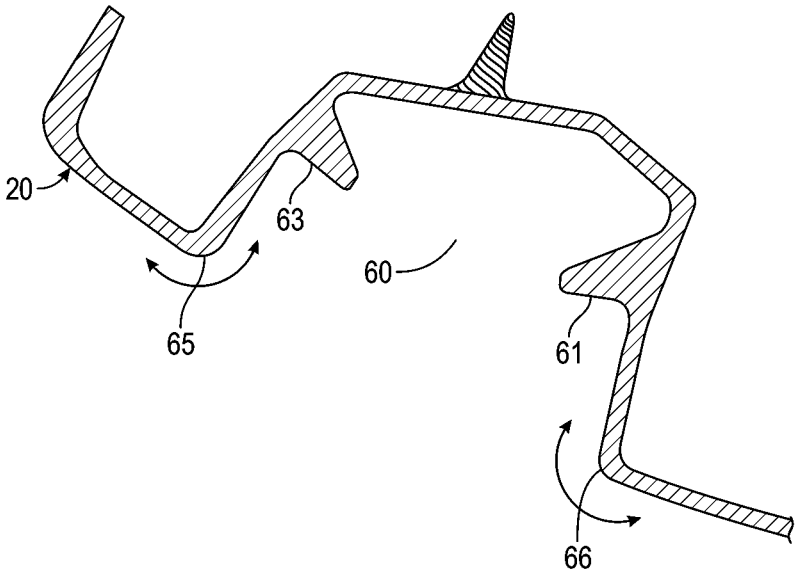
FIG. 5 is a cross-sectional view of the channel shown in FIG. 3 taken along lines 5-5.

In any of the embodiments shown herein, internal ribs 50 may be used for additional support, though these ribs 50 can be fewer in number and have a lower overall mass what is required in prior art club heads 10 due to the benefits provided by the external support structures. The stiffening members 70 in the embodiments disclosed herein bridge the thin walled channel 60 and provide a weight efficient solution to attenuating low mode shapes compared to conventional inner mold line (IML)-only rib structures. Mode shapes associated with the channel 60 are typically linked to the movement of the hinges 65, 66 of the channel 60 as shown by the arrows in FIG. 5. Generally speaking, low frequency fundamental mode shapes, when excited with a short impulse from a golf ball impact, tend to be loud and unappealing to golfers. Adding external stiffening members 70 that bridge the channel 60 increases the compliance of the channel 60, thus preventing any low frequency mode shapes. Since these members 70 are very effective at stiffening the structure, they offer a solution that is much lighter than use of multiple conventional ribs 50 on the inside of the golf club head 10.

Figure 1:
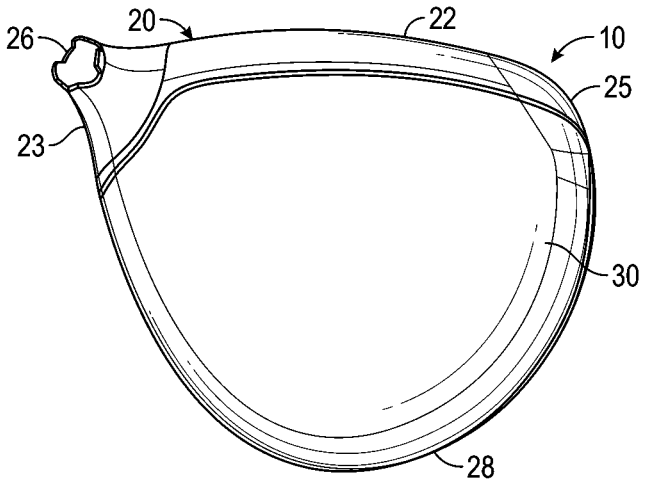
FIG. 1 is a top plan view of a prior art golf club head.
Figure 2:
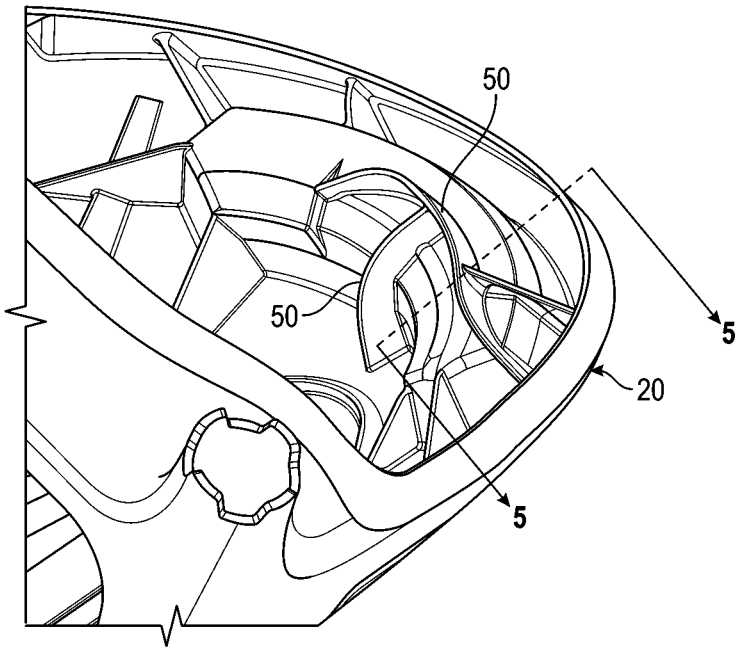
FIG. 2 is a side perspective view of the embodiment shown in FIG. 1 with its face and crown inserts removed.
Figure 3:
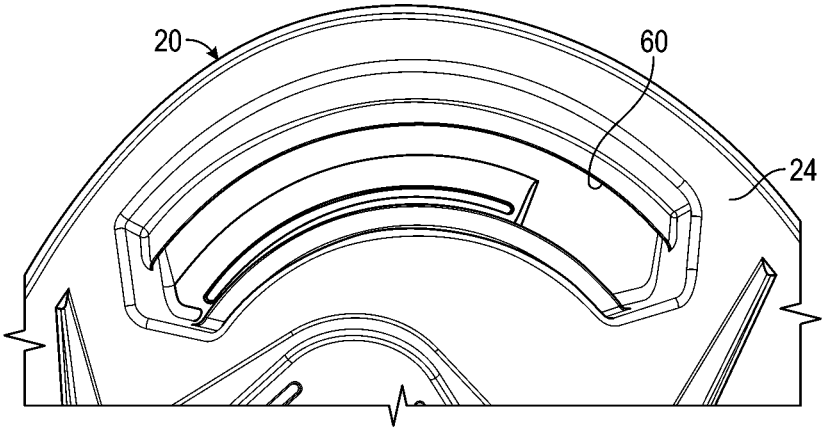
FIG. 3 is a sole plan view of the channel shown in FIG. 2.
Figure 22:
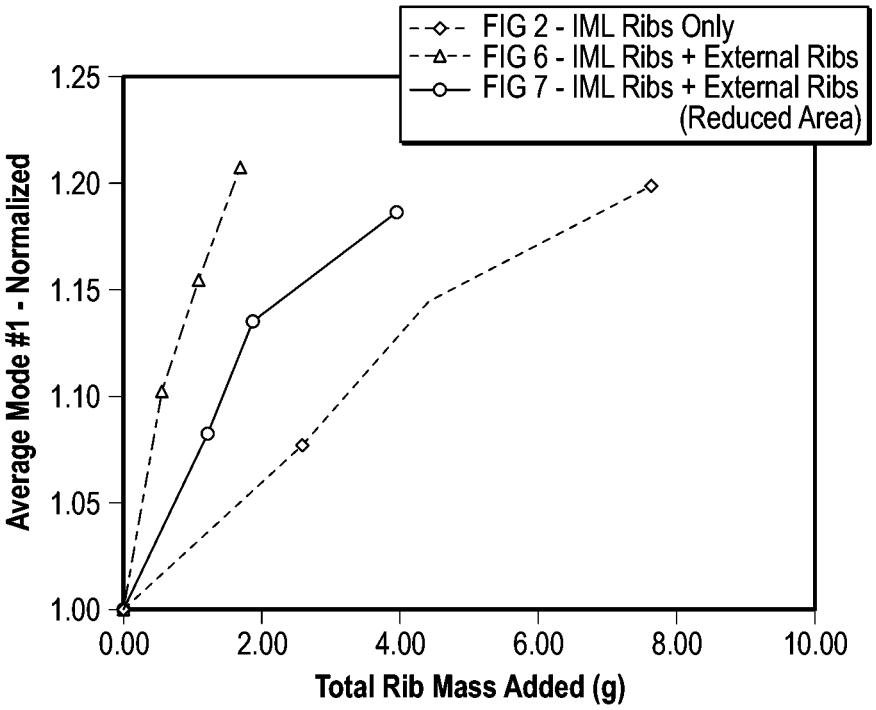
FIG. 22 is a graph of modal analyses of prior art and inventive golf club heads.

The data shown in Table I and graphed in FIG. 22 reflect modal analyses of the configurations shown in FIGS. 2, 6, and 7 (all of which include internal support ribs 50) and support this conclusion.

TABLE I

| FIG. 2 | | FIG. 6 | | FIG. 7 | |
|---|---|---|---|---|---|
| Mode #1 Normalized | Mass (g) | Mode #1 Normalized | Mass (g) | Mode #1 Normalized | Mass (g) |
| 1.00 | 0.00 | 1.00 | 0.00 | 1.00 | 0.00 |
| 1.08 | 2.59 | 1.10 | 0.55 | 1.08 | 1.22 |
| 1.14 | 4.42 | 1.15 | 1.08 | 1.14 | 1.87 |
| 1.20 | 7.63 | 1.21 | 1.69 | 1.19 | 3.95 |

In this case, each data point is associated with an optimized golf club solution and that golf club head's respective mass. Each solution is optimized for a specific first modal frequency of the body 20 outside of the first six rigid body modes. Table I and FIG. 22 illustrate that the configurations of FIGS. 6 and 7 provide far more weight efficient solutions. For example, in order to raise the average first mode frequency by 15%, 4 grams worth of ribs 50 were needed for the embodiment shown in FIG. 2, whereas the configurations shown in FIGS. 6 and 7 only required 1.1 grams and 1.87 grams of rib 50 mass, respectively.

Figure 4:
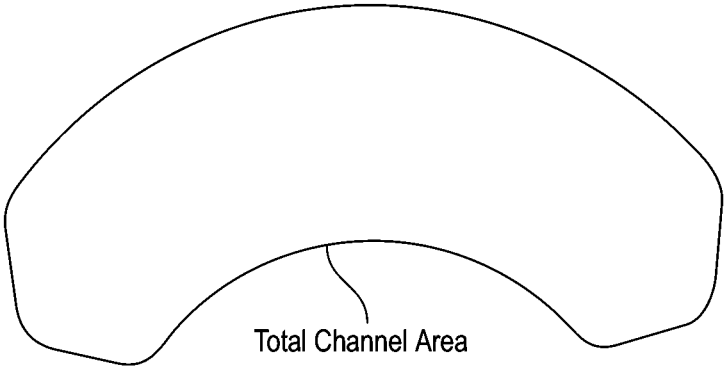
FIG. 4 is an illustration of the area of the channel shown in FIG. 2.

In all of the embodiments disclosed herein, the footprint or relative size of the stiffening members 70 can be quantified as follows. The total projected area of the channel 60, Total_Channel_Area, is shown in FIG. 4. The area of each stiffening member 70 bridging the channel 60, Area_Member, is illustrated in the dotted lines shown in FIGS. 9, 11, and 17, and the total area of stiffening members 70 bridging the channel 60, Total_Member_Area, satisfy the equation $$\text{Total Member Area} = \sum_{i=1}^{n} \text{Area } Member_i,$$

wherein n equals the total number of stiffening members 70. The relative amount of coverage of these stiffening members 70 is quantified using a non-dimensional number specified by the equation $$Member_{ratio} = \frac{\text{Total Member Area}}{\text{Total Channel Area}},$$

where $Member_{Ratio}$ can vary between 0 and 1. When $Member_{Ratio}$ is equal to 0, no stiffening members 70 bridge the channel 60. When $Member_{Ratio}$ is equal to 1, the channel 60 is fully enclosed, as shown in FIG. 6. $Member_{Ratio}$ preferably ranges from 0.001 to 1.

In any of the embodiments shown herein, the golf club head 10 has a face 22, sole 24, crown 30 (usually a separate piece made of composite), a heel side 26, a hosel 23, a toe side 25, and a rear side 28. The channel 60 of the present invention is preferably located in the sole 24 of the body 20 proximate the rear side 28, but in alternative embodiments it may be located elsewhere on the golf club head 10.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications, combinations, and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a sole with a channel; and a support structure comprising at least one stiffening member, the support structure bridging at least a portion of the channel, wherein the at least one stiffening member comprises an Area Member representing the area of the at least one stiffening member that bridges the channel, wherein the channel comprises a Total Channel Area, wherein the support structure comprises a Total Member Area, which is equivalent to $$\sum_{i=1}^{n} \text{Area } Member_i,$$

wherein n=the number of stiffening members, wherein $$Member_{ratio} = \frac{\text{Total Member Area}}{\text{Total Channel Area}},$$

and wherein $Member_{Ratio}$ is no less than 0.001 and no greater than 1.

2. The golf club head of claim 1, wherein $Member_{Ratio}$ is no less than 0.02 and no greater than 0.90.

3. The golf club head of claim 2, wherein $Member_{Ratio}$ is no less than 0.10 and no greater than 0.50.

4. The golf club head of claim 1, wherein the at least one stiffening member comprises a first stiffening member and a second stiffening member.

5. The golf club head of claim 4, wherein the first stiffening member is disposed proximate a first end of the channel, and wherein the second stiffening member is disposed proximate a second end of the channel.

6. The golf club head of claim 4, wherein the first stiffening member is spaced from a first end of the channel by a first distance, wherein the first stiffening member is spaced from the second stiffening member by a second distance, and wherein the first distance is approximately equal to the second distance.

7. The golf club head of claim 1, wherein the support structure is integrally formed with the body.

8. The golf club head of claim 1, wherein the support structure is formed separately from the body and is affixed to the body.

9. The golf club head of claim 8, wherein the body comprises first and second recesses on opposite sides of the channel, and wherein the support structure sits at least partially within the first and second recesses.

10. The golf club head of claim 9, wherein first and second ends of the support structure are welded, brazed, or affixed via adhesive within the first and second recesses, respectively.

11. The golf club head of claim 8, wherein the support structure is affixed to the body with one or more adhesives, brazes, or welds.

12. The golf club head of claim 1, wherein the at least one stiffening member is an approximately rectangular plate that is removably affixed to the body.

13. The golf club head of claim 1, wherein the at least one stiffening member has an hourglass shape.

14. A golf club head comprising:

a body comprising a sole with a channel; and a support structure comprising a plurality of planar stiffening members, the support structure bridging at least a portion of the channel, wherein each stiffening member of the plurality of planar stiffening members comprises an Area Member representing the area of each planar stiffening member that bridges the channel, wherein the channel comprises a Total Channel Area, wherein the support structure comprises a Total Member Area, which is equivalent to $$\sum_{i=1}^{n} \text{Area } Member_i,$$

wherein n=the number of planar stiffening members, wherein $$Member_{ratio} = \frac{\text{Total Member Area}}{\text{Total Channel Area}},$$

and wherein $Member_{Ratio}$ is no less than 0.001 and no greater than 1.

15. The golf club head of claim 14, wherein at least one stiffening member of the plurality of stiffening members comprises a rib extending along a longitudinal axis of the at least one stiffening member.

16. The golf club head of claim 14, wherein each stiffening member of the plurality of stiffening members comprises a thickness of 0.015 to 0.150 inch.

17. The golf club head of claim 14, wherein at least one stiffening member of the plurality of stiffening members bridges a midpoint of the channel.

18. The golf club head of claim 14, wherein at least one stiffening member of the plurality of stiffening members is composed of a material that differs from a material of the body.

19. The golf club head of claim 14, wherein at least one stiffening member of the plurality of stiffening members has an hourglass shape.

20. The golf club head of claim 19, wherein each stiffening member of the plurality of stiffening members has an hourglass shape.

* * * * *